US007972148B2

(12) United States Patent
Hiramatsu

(10) Patent No.: US 7,972,148 B2
(45) Date of Patent: Jul. 5, 2011

(54) MALE CONNECTOR AND PRINTED BOARD ASSEMBLY EQUIPPED WITH MALE CONNECTOR

(75) Inventor: Shinya Hiramatsu, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 12/873,866

(22) Filed: Sep. 1, 2010

(65) Prior Publication Data

US 2011/0070762 A1 Mar. 24, 2011

(30) Foreign Application Priority Data

Sep. 23, 2009 (JP) ..... 2009-218325

(51) Int. Cl.
*H01R 12/00* (2006.01)

(52) U.S. Cl. ..... 439/79

(58) Field of Classification Search ..... 439/79, 439/329, 80, 81, 83, 357, 358
See application file for complete search history.

(56) References Cited

U.S. PATENT DOCUMENTS

| | | | | |
|---|---|---|---|---|
| 6,280,246 | B1 | 8/2001 | Sawayanagi | 439/567 |
| 6,371,796 | B2 | 4/2002 | Fukuda | 439/489 |
| 6,666,719 | B1 | 12/2003 | Kuroi et al. | 439/607.19 |
| 7,192,297 | B1 | 3/2007 | Wu | 439/358 |
| 7,238,032 | B2 | 7/2007 | Pabst et al. | 439/67 |
| 7,249,957 | B2 | 7/2007 | Watanabe et al. | 439/79 |
| 7,322,845 | B2 | 1/2008 | Regnier et al. | 439/352 |
| 2003/0171032 | A1 | 9/2003 | Kobayashi | 439/607 |

FOREIGN PATENT DOCUMENTS

| | | |
|---|---|---|
| JP | A-2005-129275 | 5/2005 |
| JP | A-2009-117182 | 5/2009 |

*Primary Examiner* — Chandrika Prasad
(74) *Attorney, Agent, or Firm* — Oliff & Berridge, PLC

(57) ABSTRACT

A new printed board assembly equipped with a male connector is provided. The male connector simplifies a connecting structure at a printed board side while maintaining stability in connection between an external electrical cable and an electrical conductive path on a printed board by being attached to an end of the external electrical cable. A housing contains a male terminal connected to an end of an external electrical cable. While the housing is held on a printed board by a lock means, a biasing means applies a biasing force to the male terminal, so that the male terminal is pressed onto and connected to an electrical conductive path on the printed board.

18 Claims, 2 Drawing Sheets

MALE CONNECTOR AND PRINTED BOARD ASSEMBLY EQUIPPED WITH MALE CONNECTOR

BACKGROUND

1. Technical Field

This invention relates to a male connector that is connected to an end of an external electrical cable and is detachably attached to a printed board, and to a printed board assembly equipped with the male connector.

2. Background Art

A printed board is often provided with an electrical conductive path defining a given circuit pattern and electrical parts such as relays, capacitors, and transistors are mounted on the printed board. Various kinds of electrical devices such as an electrical junction box for a motor vehicle adopt the printed board in order to enhance efficiency in an electrical wiring. An external electrical cable is electrically connected to the electrical conductive path on the printed board so that the electrical devices exert particular functions.

A connection between the external electrical cable and the electrical conductive path on the printed board generally utilizes a detachable connector in view of production and assembling works. Specifically, a male terminal coupled to the external electrical cable is electrically connected to a female terminal coupled to the electrical conductive path on the printed board by coupling the male connector to the female connector. Such an electrical device is disclosed in, for example, JP 2005-129275 A (Patent Document 1).

However, it is necessary for the conventional connector connection to provide a male connector on an external electrical cable side and a female connector on a printed board side. This will increase the number of parts and will make a producing process complicated. Particularly, in order to obtain a stable connecting condition, it is necessary to strongly attach the female connector to the printed board. As shown in FIG. 6 in Patent Document 1, the female connector must be secured to the printed board by bolts. This will further increase the number of parts and will introduce a complicated structure and troublesome works in producing.

[Patent Document 1] JP 2005-129275 A

SUMMARY

In view of the above problems, an object of the present invention is to provide a new male connector and a new printed board assembly equipped with the male connector that can simplify a connecting structure at a printed board side while maintaining stability in connection between an external electrical cable and an electrical conductive path on a printed board by attaching the male connector to an end of the external electrical cable.

In a first embodiment, a male connector is connected to an end of an external electrical cable and is attached to a printed board having an electrical conductive path, so that said male connector electrically connects the external electrical cable to the electrical conductive path. The male connector comprises: a male terminal connected to the end of the external electrical cable; a housing for containing the male terminal; a lock means for detachably holding the housing on the printed board; and a biasing means for applying a biasing force to the male terminal to push and connect the male terminal to the electrical conductive path on the printed board when the housing is held to the printed board by the lock means.

According to the male connector in the first embodiment, since the male connector connected to the end of the external electrical cable can be held directly on the printed board, it is possible to eliminate the need for a female connector that has been secured to a printed board in the prior art. This can reduce the number of parts. That is, since the biasing means is provided on the male connector, the electrical conductive path, onto which the male terminal is pushed, is merely formed on the printed board, thereby stably maintaining electrical continuity between the male terminal and the electrical conductive path with the male connector being attached to the printed board.

A fixing force of the lock means can prevent the male connector from being disengaged from the housing. A biasing force of the biasing means can surely achieve an electrical connection between the connecting land portion on the electrical conductive path and the distal end portion of the male terminal. Thus, even if the female connector is eliminated, it is possible to obtain strong and secure electrical connection between the external electrical cable and the electrical conductive path. Further, since a complicated structure of attaching the female connector to the printed board can be eliminated, it is possible to simplify the male connector. In addition, an effective area of the printed board becomes great.

In a second embodiment, a bend on the male terminal of the male connector constitutes the biasing means.

According to the male connector in the second embodiment, the biasing means does not require a particular member and has a simple structure.

In a third embodiment, the lock means of the male connector is integrated with the housing. In addition, the lock means includes an engaging portion that protrudes from the housing toward the printed board and engages and disengages the printed board.

According to the male connector in the third embodiment, since the lock means for detachably holding the male connector on the printed board is integrated with the housing, it is possible to form the lock means having a simple structure in comparison with the case of using a bolt or a separated engaging member.

In a fourth embodiment, the housing of the male connector includes a peripheral wall that surrounds a containing space of the male terminal, a distal end portion of the male terminal protrudes from an opening end surface on the peripheral wall toward the printed board, and the distal end portion of the male terminal can be elastically deformed into the containing space in the housing by the biasing means.

According to the male connector in the fourth embodiment, since it is possible to realize stable electrical continuity even if the electrical conductive path is coplanar with the printed board on an area with which an end of the peripheral wall contacts, the male terminal has a simple structure and can be readily produced. It is possible to enhance stability in connector connection by contacting the peripheral wall end of the housing with the printed board when the male terminal is pushed onto the electrical conductive path. In addition, it is easy to confirm a connecting condition between the male terminal and the electrical conductive path.

In a fifth embodiment, a printed board assembly is equipped with a male connector. The male connector is detachably attached to a printed board provided with an electrical conductive path. The electrical conductive path on the printed board is provided with a flat connecting land portion that spreads on a surface of the printed board. The printed board is provided on a position outside the connecting land portion with a securing portion to which the lock means of the male connector is held. The male connector is attached to the printed board by holding the lock means on the securing portion. The male terminal of the male connector is pushed to a solder adhered to the connecting land portion on the printed board by a biasing force exerted in the biasing means to maintain electrical continuity between the male terminal and the electrical conductive path.

According to the printed board assembly in the fifth embodiment, since the male terminal can be surely held (continued) in the solder on the connecting land portion by the biasing force exerted in the biasing means, it is not necessary to provide an inserting aperture in the printed board and solder the terminal in the inserting aperture. Consequently, not only production of the printed board becomes easy but also a wide area on the rear side of the printed board can be utilized as a mounting surface. This can reply to current requirement for high density on the printed board.

In a sixth embodiment, the housing includes a peripheral wall that surrounds a containing space of the male terminal of the male connector, a distal end portion of the male terminal protrudes from an opening end surface of the peripheral wall toward the printed board, and a length of the male terminal protruding outward from the opening end surface of the peripheral wall is set to be smaller than a thickness of a solder on the connecting land portion on the printed board.

According to the printed board assembly in the sixth embodiment, it is possible to prevent the distal end (the pushing end) of the male terminal from penetrating the solder on the connecting land portion. That is, although the present invention does not exclude the embodiment in which the distal end of the male terminal penetrates the connecting land portion or the solder on the connecting land portion, it is possible for the distal end portion of the male terminal to avoid to penetrate the solder by adjusting a projecting length of the distal end portion of the male terminal to be a given length, and is possible to restrain faults in electrical continuity and instability in association with the penetration.

Since the male terminal connected to the end of the external electrical cable is pushed onto and connected to the electrical conductive path on the printed boar with the biasing force being applied to the male terminal, it is possible to simplify the connecting structure at the printed board side while maintaining stability in connection between the electrical conductive path on the printed board and the external electrical cable.

DETAILED DESCRIPTION OF EMBODIMENTS

Figure 1:
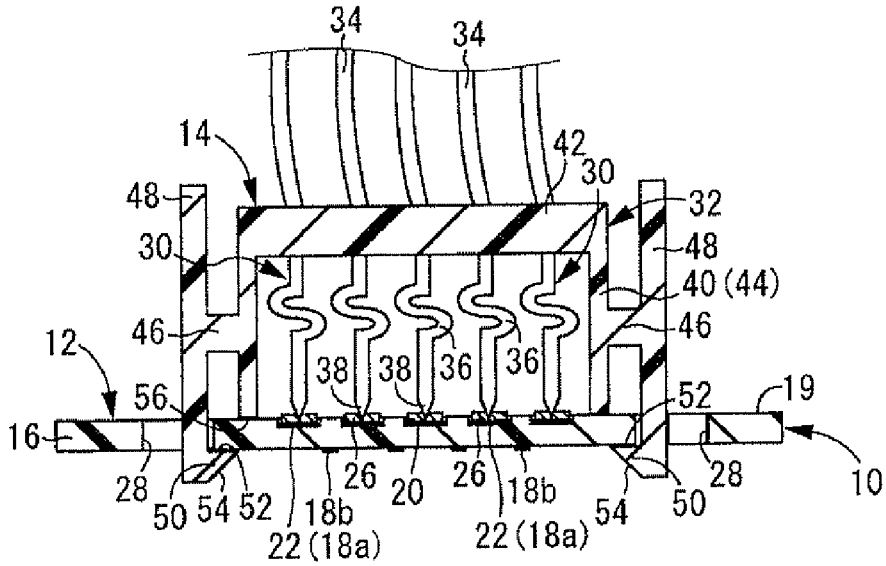
FIG. 1 is a longitudinal section view of an embodiment of a printed board assembly equipped with a male connector in accordance with an exemplary embodiment.

Referring now to the drawings, exemplary embodiments of the will be described below.

FIG. 1 shows an embodiment of a printed board assembly 10 equipped with a male connector 14 in accordance with an exemplary embodiment. The printed board assembly 10 includes a printed board 12 and the male connector 14 detachably mounted on the printed board 12. Hereinafter, a vertical direction designates upper and lower directions in FIG. 1.

Figure 2:
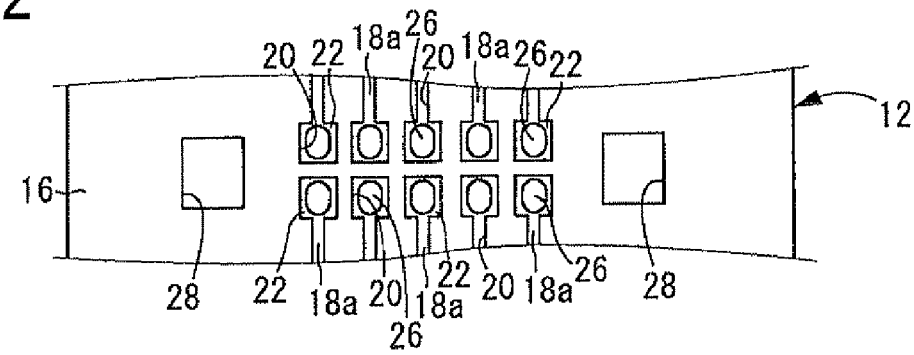
FIG. 2 is a plan view of a main part of the printed board constituting the printed board assembly shown in FIG. 1.
Figure 3:
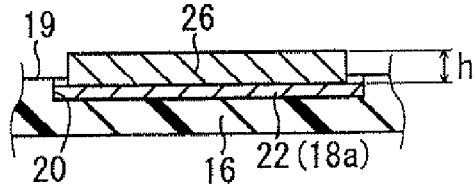
FIG. 3 is an enlarged section view of a main part of the printed board shown in FIG. 2.

Specifically, as shown in FIGS. 2 and 3, the printed board 12 includes a hard insulation plate 16, and electrical conductive paths 18*a* and 18*b* provided with both sides of the insulation plate 16 to define a double side printed wiring plate. In particular, the electrical conductive path 18*a* on a board front side 19 of the insulation plate 16 is provided in recesses 20 in the board front side 19. Thus, it is possible for each of the recesses 20 to restrain a height of each of cream solders 26 adhered to each of connecting land portions 22 (mentioned after) from protruding from the board front side 19.

The electrical conductive path 18*b* on a rear side of the insulation plate 16 is provided on a rear side of an area on which the connecting land portions 22 (mentioned after) are provided. Although the rear side electrical conductive path 18*b* is provided directly on the rear side of the insulation plate 16 in the present embodiment, recesses may be provided in a rear side of the insulation plate 16 and the electrical conductive path 18*b* may be formed in the recesses, as is the case with the electrical conductive path 18*a* on the board front side 19.

Ten connecting land portions 22 are provided on the electrical conductive path 18*a* on the board front side 19 of the insulation plate 16. All of the connecting land portions 22 are formed into rectangular flat plate-like configurations having the same sizes.

Five connecting land portions 22 define each of two lines. The connecting land portions 22 are separated equally from one another every line. The connecting land portions 22 on two lines are disposed on the same positions in an arranging direction.

The connecting land portions 22 are formed into flat surfaces coplanar to the board front side 19 of the insulation plate 16. Each cream solder 26 is adhered to the surface of each connecting land portion 22.

The printed board 12 is provided with two securing apertures 28 on the outside of the connecting land portions 22. The securing apertures 28 are formed into rectangular shapes having the same sizes and penetrate the insulation plate 16 in its thickness direction. Each of the securing apertures 28 is disposed on opposite sides of the connecting land portions 22 in the arranging direction.

Figure 4:
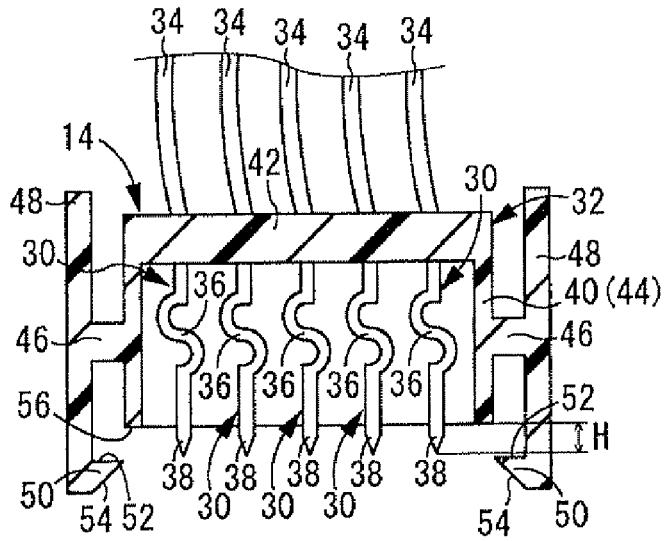
FIG. 4 is a longitudinal section view of the male connector constituting the printed board assembly equipped with the male connector shown in FIG. 1.

As shown in FIG. 4, in the male connector 14 to be attached to the printed board 12, male terminals 30 are contained in a housing 32.

Each male terminal 30 is formed into a rod shape by pressing a metallic sheet coated with an electrical conductive plating layer. The male terminal 30 is provided on a proximal end with a press-contact portion (not shown). The press-contact portion of the male terminal 30 is crimped on an end of an external electrical cable 34. Thus, the male terminals 30 and external electrical cables 34 are electrically interconnected with one another. This crimping process of the press-contact portions can adopt a conventional crimping process that has been well known in the prior art.

Each male terminal 30 is provided on a middle part with an S-shape bend 36 that serves as a biasing means. Thus, each bend 36 permits each male terminal 30 to elastically deform in its longitudinal direction. The bend 36 is not limited to the S-shape. For example, it may be formed into a spiral shape. The biasing means may not be always provided on the male terminal 30. For example, the biasing means may elastically support an upper wall 42 of a housing 32 (described below) on a peripheral wall 40.

A distal end portion 38 of each male terminal 30 is tapered so that a cross section is decreased gradually from a proximal end to a distal end in a longitudinal direction. The distal end portion 38 is not limited to this tapered shape. For example, it may be formed into a bend. If the distal end portion 38 is bent, the bend 36 may be provided on the distal end portion 38 as the biasing means.

The housing 32 that contains the male terminals 30 is made of synthetic resin and includes a peripheral wall 40 having a rectangular frame-like configuration and an upper wall 42 that closes an upper opening in the peripheral wall 40.

A pair of wall portions 44 of the peripheral wall 40 are opposed to each other in a longitudinal direction (right and left directions in FIG. 2) and are provided with support portions 46 extruding outward. Each support portion 46 is provided on its projecting end with a lock portion (lock means) 48.

The lock portion 48 is made of synthetic resin and is generally formed into a rectangular thick plate. The lock portion 48 is provided on an end in a longitudinal direction with an engaging portion 50 projecting in a thickness direction.

The engaging portion 50 is formed into a substantially right triangle in cross section in a width direction (a direction vertical to a paper in FIG. 4) to extend straightly. Thus, the engaging portion 50 is provided with an engaging surface 52 that spreads in a direction orthogonal to the longitudinal direction of the lock portion 48 and with a slant surface 54 that gradually decreases its height from the lock portion 48 smaller than that of the engaging surface 52 toward an end side in the longitudinal direction of the lock portion 48.

Such lock portion 48 is integrated with a projecting end of a support portion 46 on a substantially middle part on one side provided with the engaging portion 50 in a thickness direction. The lock portion 48 extends in a height direction of the housing 32 in parallel to the wall portion 44. The engaging portion 50 is disposed outside an opening end surface 56 of the peripheral wall 40 in an opening direction.

When the housing 32 is attached to the printed board 12, an upper bottom wall 42 is provided with pushing apertures (not shown) at positions corresponding to the connecting land portions 22 on the printed board 12. A proximal end of each male terminal 30 is pushed into each pushing aperture from an inside of the housing 32. Thus, the male connector 14 is formed.

As described above, when the proximal end of each male terminal 30 is pushed into the pushing aperture, a middle part of the male terminal 30 in the longitudinal direction is disposed within the peripheral wall 40, and the distal end portion 38 of each male terminal 30 protrudes outside the opening end surface 56 of the peripheral wall 40. A projecting height H of the male terminal 30 from the opening end surface 56 is set to be smaller than a thickness h of the cream solder 26.

The male connector 14 is pushed onto the printed board 12 when a lower end of the lock portion 48 of the housing 32 is positioned in the securing aperture 28 in the printed board 12 from a front side of the printed board 12 and the distal end portion 38 of each male terminal 30 protrudes toward each connecting land portion 22 on the printed board 12. At this time, a peripheral edge around each securing aperture 28 slides on the slant surface 54 of each engaging portion 50, a lower end of the lock portion 48 is deflected outward in the longitudinal direction of the housing 32, and the male connector 14 approaches the printed board 12. When a sliding action between the slant surface 54 of the engaging portion 50 and the peripheral edge around the securing aperture 28 is finished and the engaging portion 50 passes the securing aperture 28 to be disposed at a rear side of the printed board 12, the lock portion 50 returns to the original state by its elasticity. Thus, the engaging surface 52 of the engaging portion 50 is superimposed on the peripheral edge around the securing aperture 28 from a rear side of the printed board 12 and the engaging portion 50 is engaged with the peripheral edge around the securing aperture 28 from the rear side of the printed board 12. Consequently, the male connector 14 is attached to the printed board 12 with the printed board 12 being clamped between the engaging portion 50 and the opening end surface 56 of the peripheral wall 40 of the housing 32.

When the male connector 14 is attached to the printed board 12, the distal end portion 38 of the male terminal 30 protrudes outward from the opening end surface 56 of the housing 32, and the distal end portion 38 is pushed back to the housing 32. However, since the bend 36 deforms elastically, the distal end portion 38 is retracted into the housing 32 (see FIG. 2). An amount of deflection of the bend 36 is slightly exaggerated for purposes of illustration in FIG. 2.

Figure 5:
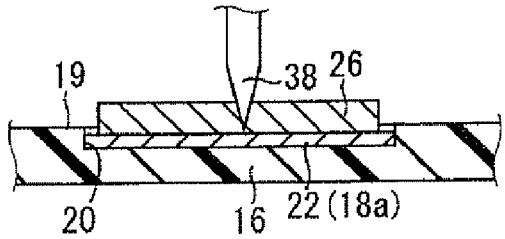
FIG. 5 is a section view of a main part of the printed board assembly equipped with the male connector.

As shown in FIG. 5, the distal end portion 38 of each male terminal 30 retracted in the housing 32 sticks the cream solder 26 on each connecting land portion 22 by a returning force (biasing force) to the original state exerted in each bend 36. In result, each external electrical cable 34 and each electrical conductive path 18*a* are electrically connected through each male terminal 30 to each other. In the present embodiment, the biasing force of the bend 36 is controlled so that the distal end portion 38 of the male terminal 30 is held to stick the cream solder 26. The distal end portion 38 of the male terminal 30 may stick the connecting land portion 22.

The male connector 14 attached to the printed board 12 by the manner described above can be released from the engagement with the opening edge around each securing aperture 28 by means of each engaging portion 50 by pushing an upper end of each lock portion 48 from the outside to the inside in the longitudinal direction of the housing 32 so that lower ends of the respective lock portions 48 are separated away each other in the longitudinal direction of the housing 32. When the engaging portion 50 is disengaged from the opening peripheral edge around the securing aperture 28, the male connector 14 can be detached from the printed board 12 by displacing the engaging portion 50 through the securing aperture 28 from the rear side of the printed board 12 to its front side.

Since the male connector 14 is secured directly to the printed board 12 in the printed board assembly 10, it is not necessary to provide a female connector, which has been required in the prior art, on the printed board 12. In result, it is possible to reduce the number of parts that are required to attach the male connector 14 to the printed board 12.

When the male connector 14 is held to the printed board 12, since the distal end portion 38 of the male terminal 30 is held to stick the cream solder 26 by the biasing force exerted in the bend 36, it is possible to surely establish electrical continuity between the male terminal 30 and the electrical conductive path 18*a*. Thus, it is not necessary to provide the printed board 12 with an inserting aperture through which the distal end portion 38 of the male terminal 30 passes and to solder the distal end portion 38 that passes the inserting aperture to the printed board 12. Consequently, it is possible to form the electrical conductive path 18*b* on the rear side corresponding to the attaching position of the male connector 14 on the printed board 12.

Since the distal end portion 38 of the male terminal 30 is tapered, the distal end portion 38 can stick the cream solder 26 positively, even if an oxide film is formed on a surface of the cream solder 26. Thus, electrical continuity between the male terminal 30 and the electrical conductive path 18*a* can be obtained.

Since the male terminal 30 protrudes outward from the opening end surface 56 of the housing 32, electrical continuity between the male terminal 30 and the electrical conductive path 18*a* can be maintained stably, even if the electrical conductive path 18*a* is provided in the recesses 20 in the printed board 12.

Since the male terminal 30 and electrical conductive path 18*a* are interconnected to each other so long as the opening end surface 56 of the housing 32 is superimposed on the printed board 12, it is easy to confirm a connecting condition between the male terminal 30 and the electrical conductive path 18*a*.

Since the projecting height H of the male terminal 30 from the opening end surface 56 is set to be smaller than the thickness h of the cream solder 26, it is possible to avoid a trouble that the distal end portion 38 of the male terminal 30 penetrates the cream solder 26 and the connecting land portion 22 with the male connector 14 being attached to the printed board 12. In result, it is possible to prevent a failure in electrical continuity between the male terminal 30 and the electrical conductive path 18*a*.

Since the bend 36 provided on the male terminal 30 constitutes the biasing means, it is not necessary to provide another member for biasing the male terminal 30. Consequently, it is possible to simplify the male connector 14.

Since the lock portion 48 integrated with the housing 32 constitutes the lock means, it is possible to simplify the lock means in comparison with the case of using bolts or the like in the prior art.

Since the opening end surface 56 of the housing 32 is superimposed on the surface of the printed board 12 with the male connector 14 being attached to the printed board 12, it is possible to stably maintain attaching condition between the male connector 14 and the printed board 12.

Although embodiments are described above specifically, it should be noted that the present invention is not limited to the embodiments. For example, the lock means can include a bolt-fastening means. Also, a reinforcing member such as a hardware or resin may be attached to the lock means in order to reinforce the printed board.

In the case where a portion to be stuck by the male terminal in the electrical conductive path on the printed board protrudes from the surface of the printed board, the distal end portion of the male terminal may not be protrude from the opening end surface of the peripheral wall of the housing.

The biasing force of the bend 36 can be controlled discretionarily. The distal end portion 38 of the male terminal 30 may penetrates the cream solder 26 or the connecting land portion 22.

Figure 6:
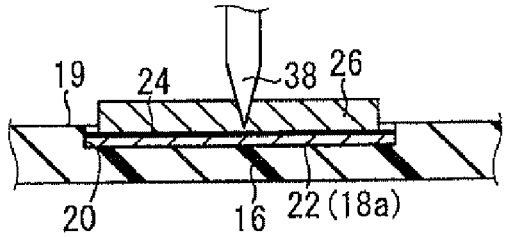
FIG. 6 is an enlarged section view of a main part of a structure that can be adopted as the printed board assembly equipped with the male connector in accordance with an exemplary embodiment.

As shown in FIG. 6, the surfaces of the connecting land portions 22 may be covered with solder levelers 24 and the cream solders 26 may be adhered to the solder levelers 24. In this case, a connecting function between the cream solders 26 and the connecting land portions 22 can be improved and the male terminals 30 can readily stick the soft cream solders 26. The distal end portions 38 of the male terminals 30 may penetrate the solder levelers 24 by controlling the biasing force of the bends 36.

What is claimed is:

1. A male connector that is connected to an end of an external electrical cable and is attached to a printed board having an electrical conductive path, so that the male connector electrically connects the external electrical cable to the electrical conductive path, the male connector comprising:

a male terminal connected to the end of the external electrical cable;

a housing for containing the male terminal;

a lock means for detachably holding the housing on the printed board; and a biasing means for applying a biasing force to the male terminal to push and connect the male terminal to the electrical conductive path on the printed board when the housing is held to the printed board by the lock means.

2. A male connector according to claim 1, wherein the biasing means constitutes a bend on the male terminal.

3. A male connector according to claim 1, wherein the lock means is integrated with the housing, the lock means including an engaging portion that protrudes from the housing toward the printed board and engages and disengages the printed board.

4. A male connector according to claim 1, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing means.

5. A printed board assembly comprising a male connector according to claim 1 and a printed board to which the male connector is detachably attached, the printed board including an electrical conductive path; wherein the electrical conductive path on the printed board has a flat connecting land portion that spreads on a surface of the printed board, the printed board is positioned outside the connecting land portion, the electrical conductive path has a securing portion to which the lock means of the male connector is held, the male connector being attached to the printed board by holding the lock means to the securing portion, and the male terminal of the male connector being pushed to a solder adhered to the connecting land portion on the printed board by a biasing force exerted in the biasing means to maintain an electrical connection between the male terminal and the electrical conductive path.

6. A printed board assembly according to claim 5, wherein the housing includes a peripheral wall that surrounds a containing space of the male terminal of the male connector, a distal end portion of the male terminal protrudes from an opening end surface of the peripheral wall toward the printed board, and a length of the male terminal protruding outward from the opening end surface of the peripheral wall is set to be smaller than a thickness of a solder on the connecting land portion on the printed board.

7. A male connector according to claim 2, wherein the lock means is integrated with the housing, the lock means including an engaging portion that protrudes from the housing toward the printed board and engages and disengages the printed board.

8. A male connector according to claim 2, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing means.

9. A male connector according to claim 3, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing means.

10. A male connector according to claim 4, wherein a thickness of the distal end of the male terminal tapers in a direction toward an opening in the housing.

11. A male connector that is connected to an end of an external electrical cable and is attached to a printed board having an electrical conductive path, so that the male connector electrically connects the external electrical cable to the electrical conductive path, the male connector comprising:

a male terminal connected to the end of the external electrical cable;

a housing for containing the male terminal; and a locking device for detachably holding the housing on the printed board, wherein the male terminal is shaped to generate a biasing force within the male terminal so that the biasing force causes the male terminal to be pushed toward the electrical conductive path on the printed board when the housing is held to the printed board by the locking device.

12. A male connector according to claim 11, wherein the male terminal is bent to generate the biasing force.

13. A male connector according to claim 11, wherein the locking device is integrated with the housing, the locking device including an engaging portion that protrudes from the housing toward the printed board and engages and disengages the printed board.

14. A male connector according to claim 11, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing force generated by the shape of the male terminal.

15. A male connector according to claim 12, wherein the locking device is integrated with the housing, the locking device including an engaging portion that protrudes from the housing toward the printed board and engages and disengages the printed board.

16. A male connector according to claim 12, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing means.

17. A male connector according to claim 13, wherein the housing includes a peripheral wall that surrounds a containing space of the male terminal, a distal end portion of the male terminal protrudes from an opening end surface on the peripheral wall toward the printed board, and the distal end portion of the male terminal is elastically deformed in the containing space in the housing by the biasing means.

18. A male connector according to claim 14, wherein a thickness of the distal end of the male terminal tapers in a direction toward an opening in the housing.

* * * * *